US005921550A

United States Patent [19]

Awada

[11] Patent Number: 5,921,550

[45] Date of Patent: Jul. 13, 1999

[54] STUD POKER GAME FOR A CASINO

[76] Inventor: Yehia Awada, 3982 Roundwood St., Las Vegas, Nev. 89117

[21] Appl. No.: 09/014,293

[22] Filed: Jan. 27, 1998

[51] Int. Cl.[6] ..... A63F 1/00

[52] U.S. Cl. ..... 273/292

[58] Field of Search ..... 273/292, 274; 463/13

[56] References Cited

U.S. PATENT DOCUMENTS 5,685,774 11/1997 Webb ..... 463/13
5,839,730 11/1998 Pike ..... 273/292

OTHER PUBLICATIONS

"Macao", Scarne's Encyclopedia Of Games, by John Scarne, Harper & Row Publishers, p. 290, Dec. 1973.

*Primary Examiner*—Benjamin H. Layno

[57] ABSTRACT

A player makes three equal wagers against a casino. Cheques representative of the three wagers are respectively placed within three circular indicia marked upon a covering of a table top. A first of the three wagers is resolved by dealing a first card face up and placing it within a first of three rectangular indicia that are marked upon the covering. When the first card is a 9 or higher, the player wins the first wager. A second of the three wagers is resolved by dealing a second card face up and placing it within a second of the three rectangular indicia. When the second card is a 9 or higher or the first and second cards are a pair of 2s~8s, the player wins the second wager. A third of the three wagers is resolved by dealing three additional cards face up and placing them within the third of the three rectangular indicia whereby the player has a final five card poker hand. A payout to the player on the third wager is in accordance with a payout schedule.

9 Claims, 1 Drawing Sheet

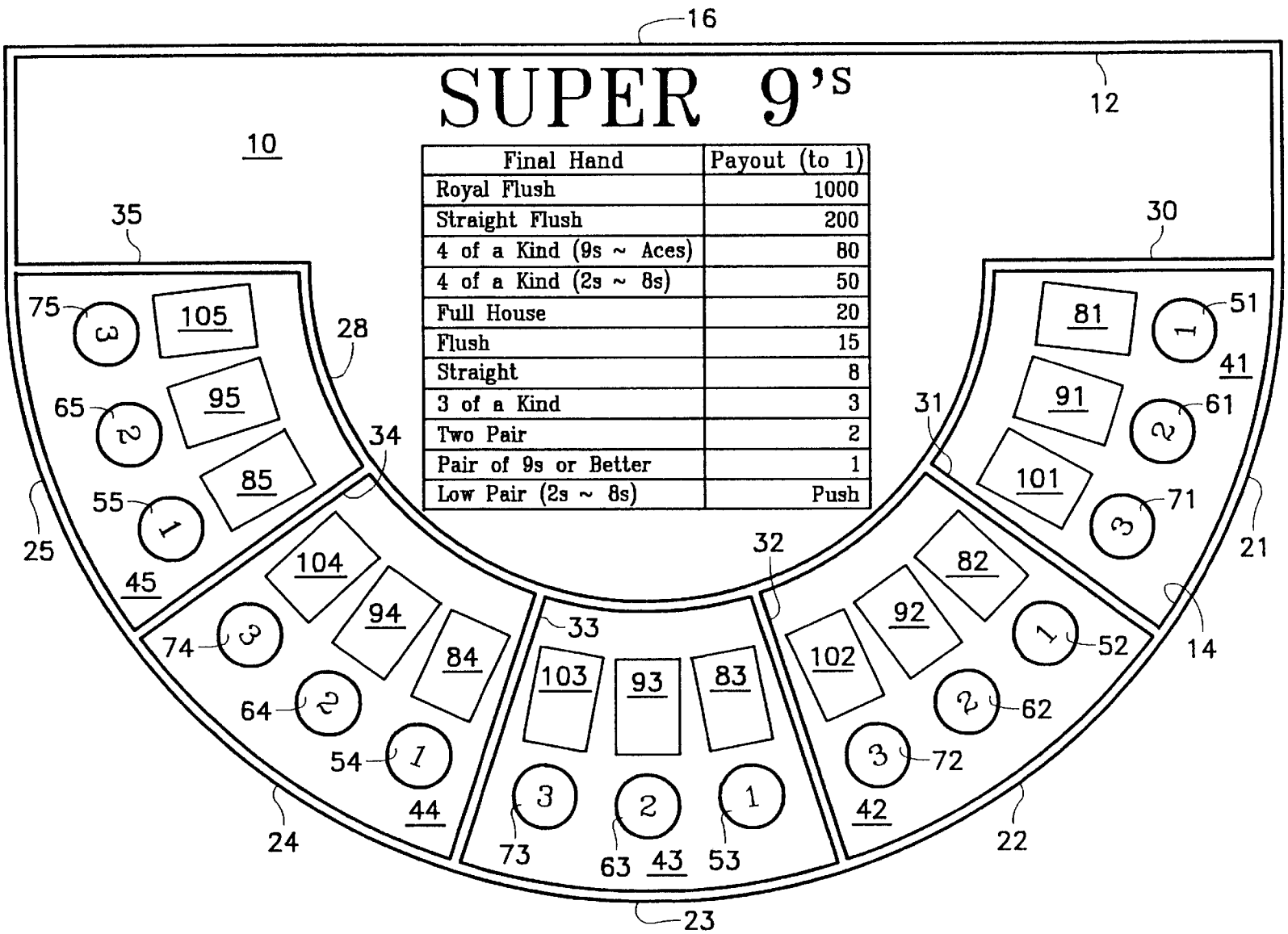
SUPER 9'S
Final Hand | Payout (to 1)
Royal Flush | 1000
Straight Flush | 200
4 of a Kind (9s ~ Aces) | 80
4 of a Kind (2s ~ 8s) | 50
Full House | 20
Flush | 15
Straight | 8
3 of a Kind | 3
Two Pair | 2
Pair of 9s or Better | 1
Low Pair (2s ~ 8s) | Push
10
12
14
16
21
22
23
24
25
28
30
31
32
33
34
35
41
42
43
44
45
51
52
53
54
55
61
62
63
64
65
71
72
73
74
75
81
82
83
84
85
91
92
93
94
95
101
102
103
104
105

STUD POKER GAME FOR A CASINO

BACKGROUND OF THE INVENTION

1. Field of Invention

This invention is in the general field of casino gaming and, more particularly, is a method of playing stud poker in a casino.

2. Description of the Prior Art

Poker is the most frequently played card game in the United States. Moreover, Poker has a gambling aspect whereby a player is permitted to wager that he holds a poker hand that is superior to poker hands held by all other players in the game. Without the gambling aspect, Poker would be one of the least frequently played card games.

Although the gambling aspect is important, Poker's popularity is enormous because wagering limits can be varied to make Poker available to rich and poor alike. Additionally, Poker is easy to learn and can be played in a multiplicity of different ways. Typically, the number of players in the game is from two to eight.

What is arguably the earliest form of poker was played with a deck of twenty cards during the 1830's on Mississippi river boats. Currently, there are approximately 100 variations of Poker, most of which are played with a conventional deck of 52 cards.

Poker games fit into one of two classes; Draw Poker and Stud Poker. In Draw Poker the player's hand is hidden from other players in the game until an identification of a winning hand is to be determined. In Stud Poker some of the cards of the player's hand are exposed to the other players, the remainder being hidden until the identification of the winning hand is to be determined.

An invariant feature of almost all Poker games is that a hand is comprised of five cards. The value of the hand is determined by its rank. The player with the highest ranking hand is usually the winner. The rankings of Poker hands, in descending order, are given as:

ROYAL FLUSH, (Ace, King, Queen, Jack and 10 of the same suit);

STRAIGHT FLUSH, (five cards in sequence in any suit, i.e. Jack, 10, 9, 8, 7, of the same suit);

FOUR OF A KIND, (four Aces is highest);

FULL HOUSE, (THREE OF A KIND plus a PAIR, i. e., 10, 10, 10, King King);

FLUSH (Five cards of the same suit);

STRAIGHT (five cards in sequence but of different suits, i.e., (Jack, 10, 9, 8, 7);

THREE OF A KIND (Three cards of the same rank, i.e., three Aces);

TWO PAIRS (i.e., two Kings and two 10's);

ONE PAIR (two 5's); and

NO PAIR

When hands of equal rank are compared, rankings of cards comprising each hand determine the highest rank. Thus, for example, a hand that comprised of a pair of 10's has a higher rank than a hand that is comprised of a pair of 9's.

In traditional Poker, one player plays against all other players. However, there is an increased desire of the management of casinos for a casino Poker game where each player plays against a dealer who represents the casino. Casino Poker can provide more revenue to the casino than traditional Poker because Casino Poker game is invariably structured to give the casino an advantage. Exemplary of Casino Poker is Caribbean Stud Poker which is described in U. S. Pat. No. 4,836,553.

SUMMARY OF THE INVENTION

An object of the present invention is to provide a Poker game in which a player plays against a casino.

According to a first aspect of the present invention, a player makes three wagers against a casino. A first card is dealt face up to the player. When the first card is higher than a predetermined rank, the player receives a first card payout from the casino on a first of the three wagers. The player loses the first wager when the first card is lower than the predetermined rank.

A second card is dealt face up to the players. When the second card either has the predetermined rank or the first and second cards are a pair, the player receives a second card payout from the casino on a second of the three wagers. The player loses the second wager when the second card is lower than the predetermined rank and the first and second cards are not a pair.

Three additional cards are dealt face up to the player whereby the player has a final five card poker hand. The player receives a final hand payout from the casino on a third of the three wagers in accordance with a final hand payout schedule.

According to a second aspect of the present invention, a casino poker game is played upon a semicircular table top with a covering that carries markings that define an area with three circular indicia and three rectangular indicia therein.

The game provides a probability of large payouts to a player as well as an increased probability of smaller payouts that should maintain the player's interest.

Other objects, features, and advantages of the invention should be apparent from the following description of embodiments thereof as illustrated in the accompanying drawing.

BRIEF DESCRIPTION OF THE DRAWING

The sole FIGURE herein is a plan view of a table top in accordance with the present invention.

DESCRIPTION OF THE PREFERRED EMBODIMENT

As shown in the drawing, in the preferred embodiment, a stud poker game is played in a casino on a table top 10 having a generally semi-circular shape. More particularly, the table top 10 has a straight edge 12 and an arcuate edge 14. Typically, a dealer (not shown) is positioned adjacent to a location 16 at the approximate center of the edge 12.

Five similar player stations are respectively adjacent to locations 21–25 along the edge 14. Accordingly, as many as five players may participate in the game. In an alternative embodiment, there are more than five player stations.

A felt covering of the table top 10 carries lettering of the name of the game, Super 9's, proximal to the edge 14. Additionally, the table top 10 covering carries a semicircular arc 28 that is parallel to the edge 14 and lines 30, 31 that extend from the edge 14 to the arc 28. At the edge 14, the lines 30, 31 are on either side of the location 21 and approximately equidistant therefrom.

The edge 14, the arc 28 and the lines 30, 31 define an area 41 wherein indicia associated with a first of the five player stations are carried. In a similar manner the edge 14, the arc 28 and lines 31–35 define areas 42–45 that are respectively associated with a second, third, fourth and fifth of the five player stations.

The table top 10 covering carries circular indicia 51–55, within the areas 41–45, respectively. Similarly, the table top 10 covering carries circular indicia 61–65 within the areas 41–45, respectively, and circular indicia 71–75 within the areas 41–55, respectively. Lettering of the numeral, 1, is carried within the indicia 51–55; lettering of the numeral, 2, is carried within the indicia 6–-65; lettering of the numeral, 3, is carried within the indicia 71–75.

At the start of play, a player at the first player station, for example, makes first, second and third wagers against the casino. The amounts of the first, second and third wagers are preferably equal. The first player places cheques representative of the first, second and third wagers within the indicia 51, 61, 71, respectively. The amounts of the wagers is within limits specified by the management of the casino.

The table top 10 covering carries rectangular indicia 81–85, within the areas 41–45, respectively. Similarly, the table top 10 covering carries rectangular indicia 91–95 within the areas 41–45, respectively, and indicia 101–105 within the areas 41–45, respectively. As explained hereinafter, cards dealt to the first player are preferably placed within the indicia 81, 91, 101.

After the three wagers are made, the first wager of the first player is resolved by dealing a first card which is preferably placed face up within the indicium 81. The first player receives a payout on the amount of the first wager in accordance with a first card payout schedule which is given as:

| FIRST CARD | PAYOUT (to 1) |
|---|---|
| 9 | 1.5 |
| 10 or higher | 1 |

Therefore, the first player loses the first wager when the first card is lower than a nine.

In order to advise the first player of the first card payout schedule, the table top 10 covering carries lettering of the words, "Any 9 Pays 3 to 2[,] 10 or better pays 1 to 1" within the indicium 81. The second, third, fourth and fifth players are similarly advised of the first card payout schedule by lettering within the indicia 82–85, respectively. First wagers of all other players are resolved in a manner described in connection with the first player.

The second wager of the first player is resolved by dealing a second card which is preferably placed face up within the indicium 91. The first player receives a payout on the second wager in accordance with a second card payout schedule which is given as:

| SECOND CARD | PAYOUT (to 1) |
|---|---|
| 9 | 1.5 |
| 10 or higher | 1 |

when the first and second cards are a pair, smaller than a pair of 9s, the second card payout is 1 to 1.

Therefore, the first player loses the second wager when the second card is lower than a 9 and the first and second cards are not a pair.

In order to advise the first player of the second card payout schedule, the table top 10 covering carries lettering of the words, "Any 9 Pays 3 to 2[,] 10 or better or a pair of 2–8 pays 1 to 1" within the indicium 91. The second, third, fourth and fifth players are similarly advised of the second card payout schedule by lettering near the indicia 92–95, respectively. Second wagers of all other players are resolved in a manner described in connection with the first player.

The third wager of the first player is resolved by dealing third, fourth and fifth cards that are preferably placed face up within the indicium 101. The first and second cards and the third fourth and fifth cards dealt to comprises a final five card poker hand. The third wager is resolved in accordance with a final hand payout schedule which is given as:

| Final Hand | Payout (to 1) |
|---|---|
| Royal Flush | 1000 |
| Straight Flush | 200 |
| 4 of a Kind (9s ~ Aces) | 80 |
| 4 of a Kind (2s ~ 8s) | 50 |
| Full House | 20 |
| Flush | 15 |
| Straight | 8 |
| 3 of a Kind | 3 |
| Two Pair | 2 |
| Pair of 9s or better | 1 |
| Low Pair (2s ~ 8s) | Push |

Third wagers of all other players are resolved in a manner described in connection with the first player.

In order to advise the first player of the gist of the final hand payout schedule, the table top 10 covering carries lettering of the words, "Pair of 9's or Better to win" within the indicium 101. The second, third, fourth and fifth players are similarly advised of the gist of the final hand payout schedule by lettering near the indicia 102–105, respectively. Additionally, lettering of the final hand payout schedule is carried on a central portion of the table top 10 covering.

It should be understood that when an exemplary player's final hand is a low pair (2s~8s), the exemplary player recovers the amount of his third wager. The recovery of the amount of the third wager is known as a push in casino gaming parlance.

An aspect of the game described herein is that the casino is at a statistical disadvantage in the resolution of the exemplary player's second wager. However, the casino enjoys a statistical advantage in the resolution of the exemplary player's first and third wagers. Because the three wagers are equal in amount, the casino has a net statistical advantage.

While the invention has been particularly shown and described with reference to a preferred embodiment thereof, it should be understood by those skilled in the art that changes in form and detail may be made therein without departing from the spirit and scope of the invention.

I claim:

1. A method of playing a stud poker game in a casino comprising the steps of:

a player making first, second and third wagers against the casino;

dealing a first card face up to said player;

making a payout to said player by the casino of said first wager when said first card has a rank that is either higher or equal to a predetermined rank;

dealing a second card face up to said player;

making a payout to said player by the casino of said second wager when said second card has a rank that is either higher or equal to said predetermined rank or said first and second cards are a pair;

dealing a third, fourth and fifth card y.a 1.22.98 to said player, whereby said player has a final poker hand;

making a payout to said player by the casino of said third wager in accordance with a final hand payout schedule.

2. The method of claim 1 wherein said first, second and third wagers are equal.

3. In the method of claim 2 wherein a 1.5 to one payout of said second wager is made when said second card is a 9.

4. In the method of claim 2 wherein a 1 to 1 payout of said second wager is made when said second card is higher than a 9.

5. The method of claim 2 wherein a 1 to 1 payout of said second card wager is made when said first and second cards are a pair that is smaller than a pair of 9s.

6. The method of claim 1 wherein a card that is a 9 has said predetermined rank.

7. In the method of claim 6 wherein a 1.5 to one payout of said first wager is made when said second card is a 9.

8. In the method of claim 6 wherein a 1 to 1 payout of said first wager is made when said second card is higher than a 9.

9. The method of claim 1 wherein said final hand payout schedule is given as:

| Final Hand | Payout (to 1) |
|---|---|
| Royal Flush | 1000 |
| Straight Flush | 200 |
| 4 of a Kind (9s ~ Aces) | 80 |
| 4 of a Kind (2s ~ 8s) | 50 |
| Full House | 20 |
| Flush | 15 |
| Straight | 8 |
| 3 of a Kind | 3 |
| Two Pair | 2 |
| Pair of 9s or better | 1 |
| Low Pair (2s ~ 8s) | Push. |

.

* * * * *